United States Patent [19]

Garafano

[11] Patent Number: 4,825,472

[45] Date of Patent: May 2, 1989

[54] SHIRT CONSTRUCTION AND ADAPTER

[76] Inventor: Ronald D. Garafano, 1 Regina Dr., Cranston, R.I. 02920

[21] Appl. No.: 104,812

[22] Filed: Oct. 5, 1987

[51] Int. Cl.[4] ..... A41B 1/02; A41B 1/08; A41B 1/16; A41B 3/02

[52] U.S. Cl. ..... 2/141 A; 2/141 R; 2/131; 2/129; 2/128; 2/121; 2/115

[58] Field of Search ..... 2/115, 116, 121, 128, 2/129, 131, 141 R, 141 A, 219, 221, 237, 900

[56] References Cited

U.S. PATENT DOCUMENTS

| | | | |
|---|---|---|---|
| 1,469,858 | 10/1923 | Van Heusen | 2/DIG. 6 |
| 4,580,298 | 4/1986 | Tuisl | 2/237 |
| 4,648,137 | 3/1987 | Cooper | 2/141 R |

FOREIGN PATENT DOCUMENTS

| | | | |
|---|---|---|---|
| 1233489 | 10/1960 | France | 2/DIG. 6 |
| 878809 | 10/1961 | United Kingdom | 2/DIG. 6 |

OTHER PUBLICATIONS

Maurice Gershman, "Self Adhering Nylon Tapes", *The Journal of the American Medical Association*; vol. 168, No. 7, p. 930 Dated: Oct. 19, 1958.

*Primary Examiner*—Werner H. Schroeder
*Assistant Examiner*—Jeanette Chapman
*Attorney, Agent, or Firm*—Salter & Michaelson

[57] ABSTRACT

A shirt construction includes an adjustable collar for accommodating different neck sizes, and an adaptor is operable in combination with a conventional shirt for adapting the collar thereof for adjustability. The shirt construction includes an extension tab which extends from a first front edge portion of the shirt adjacent the collar thereof, a reinforcing panel for reinforcing the first front edge portion and hook-and-pile-type fastening elements for adjustably securing the first front edge portion to an opposite second front edge portion adjacent the shirt collar. The adaptor includes an extension tab and a reinforcing panel which are securable to buttons on a first front edge portion of a shirt adjacent the collar thereof, a fastening tab which is securable in a collar buttonhole of a second front edge portion of the shirt, and a hook-and-pile-type fastening element for adjustably securing the extension tab to the fastening tab.

10 Claims, 2 Drawing Sheets

SHIRT CONSTRUCTION AND ADAPTER

BACKGROUND AND SUMMARY OF THE INVENTION

The instant invention relates to clothing and more particularly to a shirt construction having an adjustable collar and to an adapter for adapting the collar of a conventional shirt for adjustability.

It has generally been found that in some instances shirts having collars which are adjustable to various diameters within preset ranges have specific advantages over shirts having preset collar sizes. Specifically, it has been found that shirts having adjustable collars can often be worn more comfortably than shirts having predetermined collar sizes, and it has been found that shirts having adjustable collars can be adapted to compensate for collar shrinkage and/or variations in wearer size. Still further, it has been found that for practical reasons certain types of specialty shirts, such as formal-wear shirts which are often rented by wearers for use on special occasions, have increased effectiveness when they are embodied with adjustable collars.

However, while the benefits of providing shirts having adjustable collars have generally been heretofore recognized, the prior art has generally failed to provide an effective shirt construction having an adjustable collar or an adapter for adapting a conventional shirt for adjustability. In this regard, the closest prior art to the subject invention of which the applicant is aware is disclosed in the U.S. Pat. Nos. to Walensky #2,740,124; Schafer #2,983,006; Berger #3,142,843; Piehler #3,274,615; and Berger #3,828,365. However, most of these references disclose shirts having adjustable collars which rely on resilient elastic bands or tabs for adjustability. Unfortunately, it has been found that resilient tabs or on bands the collars of shirts of this type apply added tension to the necks of wearers so that they cause wearer discomfort. It has been further found that shirts having resilient tabs of this type are generally less than effective from an aesthetic standpoint, since the resilient tabs thereof are often highly visible during use and since the portions of the shirts which are adjacent to the tabs often sag, pull or become wrinkled when the tabs are worn in expanded dispositions.

The instant invention provides an effective and improved shirt construction having an adjustable collar and an adapter which is operable in combination with a conventional shirt for adding adjustability to the collar thereof. More specifically, the shirt construction of the instant invention comprises a shirt of the type including a collar, a first front panel including a first front edge portion, a second front panel including a second front edge portion receivable in overlapping relation on the first front edge portion, and a plurality of spaced fastening elements for releasably securing the second front edge portion in overlapping relation on the first front edge portion. The shirt construction further comprises an extension tab on one of the first or second front edge portions which extends a distance beyond the edge thereof adjacent the collar and hook-and-pile-type fastening means on the extension tab and on the other of the first or second front edge portions for adjustably securing the first and second front edge portions together adjacent the collar. The extension tab preferably extends from the edge of the first front edge portion, and the fastening means is preferably provided on the outwardly facing side of the extension tab and on the inwardly facing side of the second front panel adjacent the collar for adjustably securing the first and second front panels together so that the extension tab and the fastening means are concealed during use. The shirt construction preferably further comprises a reinforcing panel on the first front edge portion which is attached to the extension tab and extends therewith beyond the first front edge portion and downwardly therefrom at least as far as the adjacent fastening element on the first front edge portion. The reinforcing panel preferably has a stiffness which is at least double the stiffness of the first front edge portion in order to prevent the first front edge portion from becoming pulled, stretched, or wrinkled when the shirt collar is secured in an expanded position. The reinforcing panel is preferably integrally formed with the extension tab from a reinforced fabric material, and the fastening elements, other than the uppermost fastening elements, preferably comprise spaced buttons in the first front edge portion, and spaced buttonholes are formed in the second front edge portion for receiving the buttons therein. Further, the uppermost buttonhole in the second front edge portion of the shirt is preferably formed in a transversely extending disposition to enable a button to be transversely repositioned therein as the diameter of the collar of the shirt is adjusted.

For use and operation of the shirt of the instant invention, the hook-and-pile-type fastening elements on the extension tab and on the opposite front edge portion of the shirt are releasably and adjustably securable together for securing the adjacent collar edge portions of the shirt together without applying resilient tension to the neck of a wearer. The reinforcing panel reinforces the first front edge portion of the shirt, so that when the hook-and-pile-type fastening means are secured together, the adjacent front edge portions of the shirt are reinforced by the reinforcing panel and are not prone to pulling, sagging and wrinkling. Further, the transverse buttonhole in the second front edge portion is adapted to receive the uppermost button on the first front edge portion so that the button is transversely repositionable therein to further prevent wrinkling and pulling in the upper front portions of the shirt. Still further, because the extension tab is provided on the first front edge portion of the shirt, the extension tab is effectively concealed by the second front edge portion of the shirt when the collar of the shirt is secured in an expanded position. Accordingly, the collar portion of the shirt construction of the instant invention is effectively adjustable in a manner which is normally undetectable so that the shirt construction of the instant invention is effectively adapted to be embodied in a variety of types of shirts, including formal-wear shirts.

The shirt construction adapter of the instant invention is operative in connection with a conventional front buttoning shirt for adapting the collar thereof to be adjusted in a manner similar to the collar of the shirt construction of the instant invention as hereinabove set forth. More specifically, the adapter comprises an extension tab which is releasably securable to a collar button of a front buttoning type shirt so that it extends a distance beyond the adjacent front edge portion of the shirt, a fastening tab which is releasably securable in the collar buttonhole of the shirt, and hook-and-pile-type fastening means on the fastening tab and on the extension tab for adjustably securing the front edge portions of the shirt which are adjacent the collar thereof together. The adapter preferably further comprises a reinforcing panel which is preferably integrally attached to the extension tab so that it extends therewith beyond the adjacent edge of the shirt. The reinforcing panel preferably extends downwardly from the extension tab and is securable to the next-adjacent button of the shirt when the extension tab is secured to the collar button of the shirt. The reinforcing panel is preferably made in a reinforced fabric construction, and the fastening tab preferably includes a button which is receivable in the collar buttonhole of a shirt for securing the fastening tab thereto.

Accordingly, the adapter of the instant invention is operative for adapting a conventional front buttoning type shirt for use in a manner similar to the shirt construction of the instant invention. More specifically, the extension tab and reinforcing panel portions of the adapter are securable to the top two buttons on the first front edge portion of a shirt, and the fastening tab of the adapter is securable in the collar buttonhole of a shirt. The fastening means on the extension tab and on the fastening tab are releasably securable together for adjustably securing the front edge portions of a shirt together adjacent the collar thereof. The reinforcing panel extends downwardly from the extension tab for reinforcing the adjacent edge portions of the shirt to prevent wrinkling caused by pulling; and since the reinforcing panel and the extension tab are secured to the portion of the shirt to which the buttons thereof are secured, they are normally concealed by the adjacent overlaying buttonhole portion of the shirt.

Accordingly, it is a primary object of the instant invention to provide an effective shirt construction having an adjustable collar.

Another object of the instant invention is to provide an effective adapter for use with a conventional shirt to provide adjustability in the collar thereof.

Another object of the instant invention is to provide a shirt construction having an adjustable collar which has the appearance of a conventional shirt.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
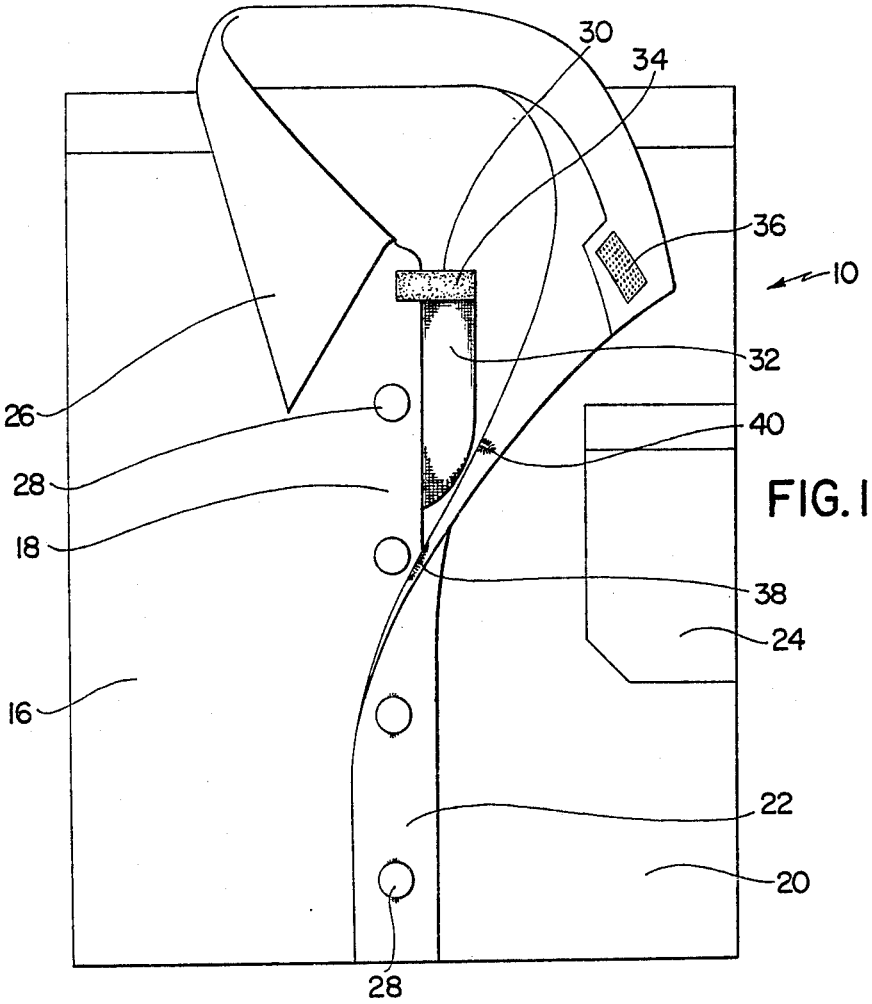
FIG. 1 is a perspective view of the shirt construction of the instant invention with the collar thereof in an open position.
Figure 2:
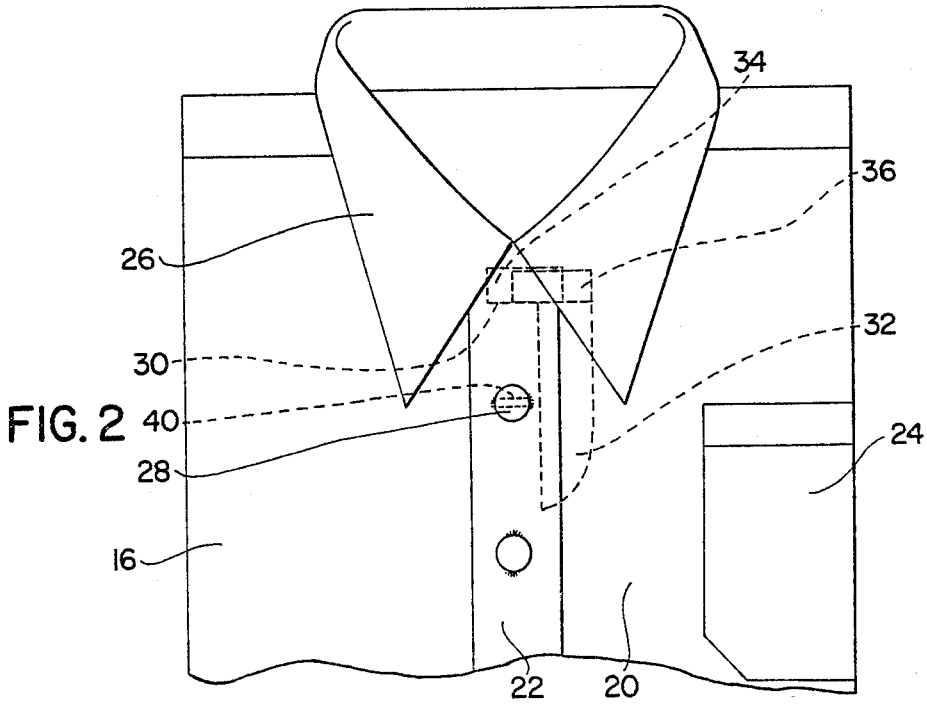
FIG. 2 is a perspective view of the shirt with the collar thereof in an adjusted and closed position.
Figure 3:
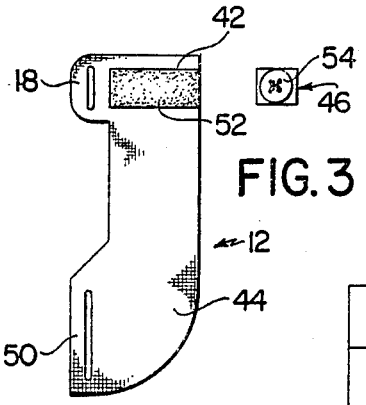
FIG. 3 is a plan view of the adapter of the instant invention.
Figure 4:
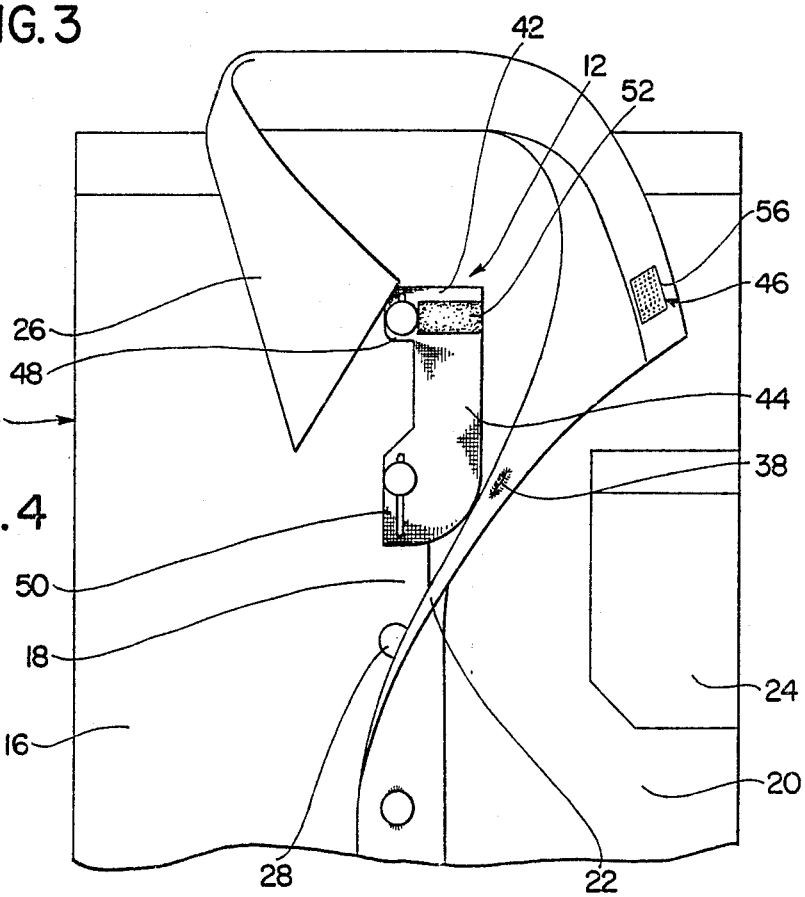
FIG. 4 is a plan view of the adapter as it is assembled on a shirt with the collar thereof in an open position.
Figure 5:
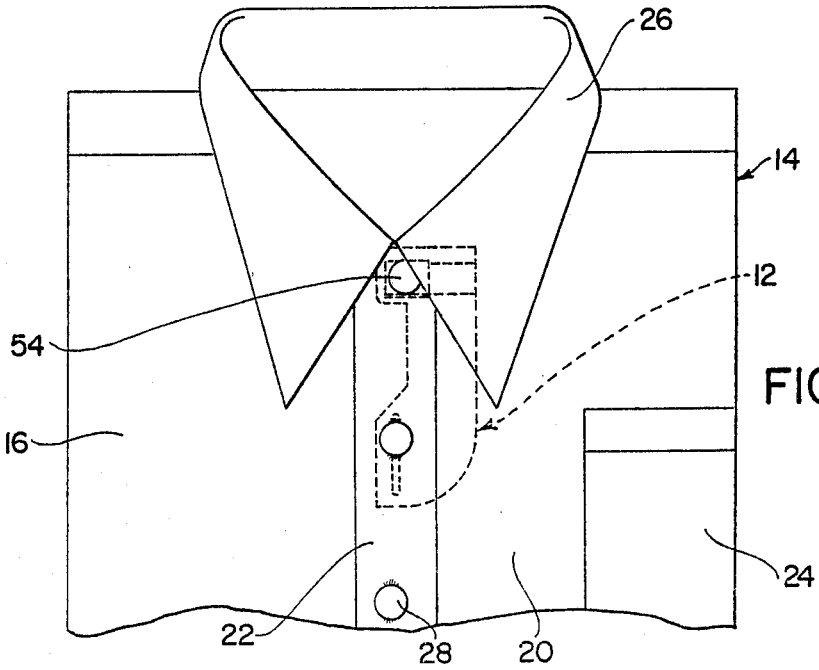
FIG. 5 is a perspective view thereof with the collar of the shirt in an adjusted and closed position.

Referring now to the drawings, the shirt construction of the instant invention is illustrated and generally indicated at 10 in FIGS. 1 and 2, and the adapter of the instant invention is illustrated and generally indicated at 12 in FIGS. 3 through 5. The shirt construction 10 is constructed so that the collar portion thereof is adjustably securable in different positions for accommodating different neck sizes within a predetermined range, and the adapter 12 is securable to a conventional shirt 14 for adapting the collar portion thereof so that it can be adjusted in a similar manner.

The shirt construction 10 is preferably embodied as a shirt of generally conventional construction, and it includes a first front panel 16 having a first front edge portion 18, a second front panel 20 having a second front edge portion 22 a front pocket 24, and a collar 26. A plurality of spaced buttonss 28 are secured to the first front edge portion 18, and an extension tab 30 extends outwardly from the edge of the first front edge portion 18 adjacent the collar 26. A reinforcing panel 32 which is integrally formed with the extension tab 30 also extends outwardly from the first front edge portion 18, the panel extending downwardly to a point below the uppermost button 28 thereon. The reinforcing panel 32 is preferably constructed of a reinforced fabric material so that it has a stiffness which is at least double the stiffness of the adjacent first front edge portion 18, and a fastening patch 34 comprising a hook-and-pile-type fastening element, such as Velcro (Velcro USA tm) is provided on the forwardly facing side of the extension tab 30. A second fastening patch 36 comprising a hook-and-pile-type fastening element of complementary configuration is provided on the inner side of the second front edge portion 22 adjacent the collar 26 so that the second patch 36 is positionable in a rearwardly facing direction and is interengageable with the first patch 34 for securing the second front edge portion 22 in overlapping relation on the first front edge portion 18 adjacent the collar 26. A plurality of vertically disposed buttonholes 38 are formed in the second front edge portion 22 for receiving the buttons 28 therein, and a substantially horizontally disposed buttonhole 40 is provided in the second front edge portion 22 for receiving the uppermost button 28 therein.

Accordingly, for use and operation of the shirt 10, the basic shirt components thereof are assembled on a wearer, and the buttons 28 are assembled in their respective buttonholes 38 and 40. The second fastening element patch 36 is then assembled in engagement with the first fastening element patch 34 to secure the collar portions of the shirt 10 together. In this regard, the fastening element patches 34 and 36 are adapted to enable the diameter of the collar 26 to be adjusted over a range of approximately one inch to accommodate different neck sizes. Further, since the second patch 36 is positioned on the rearwardly facing side of the second edge portion 22 and the first patch 34 is positioned on the two 30, the extension tab 30 and the fastening patch 34 are concealed by the second edge portion 22 during use. Still further, the reinforcing panel 32 provides added stiffness and rigidity in the upper portions of the first front edge portion 18 which prevents the fabric in the edge portions 18 and 20 from being pulled or wrinkled when the diameter of the collar 26 is secured in an expanded position with the fastening elements 34 and 36. Further, the transversely extending buttonhole 40 enables the respective button 28 thereof to be transversely repositioned in the buttonhole 40 to further prevent pulling or wrinkling of the fabric in the first and second front edge portions 18 and 22 adjacent the collar 26.

Referring now to FIGS. 3 through 5, the adapter 12 is illustrated. The adapter 12 comprises an extension tab 42 which is integrally formed with a reinforcing panel 44 and a fastening tab 46. A button loop 48 is provided on the extension tab 42, an elongated button loop 50 is provided on the reinforcing panel 44, and a hook-and-pile-type fastening element patch 52 is provided on the front side of the extension tab 64. In this regard, the reinforcing panel 44, the extension tab 42, and the button loops 48 and 50 are preferably integrally formed from a reinforced fabric material so that they have a stiffness which is at least twice the stiffness of the fabric of a conventional shirt, such as the shirt 14. The fastening tab 46 includes a button 54 on the front side thereof and a fastening element patch 56 on the rearwardly facing side thereof, the patch 56 comprising a hook-and-pile-type fastening element having a configuration which is complementary to that of the fastening element patch 52.

The adapter 12 is operative in combination with a shirt 14 of a type comprising first and second front panels 16 and 20 having first and second front edge portions 18 and 22, respectively, a collar 26, a plurality of buttons 28, and a plurality of buttonholes 38. For use and operation of the adapter 12, the button loops 48 and 50 are assembled on the uppermost two buttons 28 on the first front edge portion 18 in the manner illustrated and the button 54 on the fastening tab 46 is assembled with the collar buttonhole of the shirt 14 so that the button 54 is positioned on the front side of the second front edge portion 22 and the fastening element patch 56 faces rearwardly from the rear side thereof. The fastening element patch 56 can then be adjustably positioned in engagement with the fastening element patch 52 for adjustably securing the first and second front edge portions 18 and 22 together adjacent the collar 26. In this regard, since the adapter 12 is securable to the first front edge portion 18 so that it extends outwardly from the edge thereof, it is concealed by the second front edge portion 22 when the fastening elements 56 and 52 are secured in engagement. Further, because the fastening element patches 52 and 56 comprise hook-and-pile-type fastening elements, they are simply and easily adjustable (preferably over a range of approximately one inch) in a variety of different positions without applying resilient tension to the neck of a wearer. Still further, because the adapter 12 includes a reinforcing panel 44, the upper portions of the first and second edge portions 18 and 22 are reinforced so that they do not normally wrinkle due to pulling when the fastening element patches 52 and 56 are utilized for securing the collar 26 in expanded positions.

It is seen therefore that the instant invention provides an effective shirt construction having an adjustable collar and an effective adapter for adapting conventional shirts to enable the collars thereof to be adjusted without applying resilient tension to the necks of wearers. Further, the shirt 10 is constructed so that the reinforcing panel 32, the extension tab 30 and the fastening element patches 34 and 36 are normally concealed during use, and the adapter 12 is constructed so that it also is concealed during normal use. Hence, for these reasons as well as the other reasons hereinabove set forth, it is seen that the instant invention represents a significant advancement in the garment art which has substantial commercial potential.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a shirt construction of the type comprising a collar, a first front panel including a first front edge portion, a second front panel including a second front edge portion receivable in overlapping relation on said first front edge portion and a plurality of spaced fastening elements for releasably securing said second front edge portion in overlapping relation on said first front edge portion, the improvement comprising the uppermost of said fastening elements comprising an extension tab on said first panel extending a distance beyond the edge of said first front edge portion, and hook and pile type fastening means on the outwardly facing side of said extension tab and on the inwardly facing side of said second front panel adjacent said collar for adjustably securing said first and second front panels together adjacent said collar so that said second front edge portion overlaps said first front edge portion and so that said extension tab is concealed behind said second front panel.

2. The shirt construction of claim 1 further comprising a reinforcing panel on said first front edge portion attached to said extension tab and extending therewith beyond said first front edge portion and downwardly therefrom at least to the next-adjacent fastening element, said reinforcing panel having a stiffness which is at least double the stiffness of said first front edge portion.

3. In the shirt construction of claim 2, said reinforcing panel being integrally formed with said extension tab.

4. In the shirt construction of claim 3, said reinforcing panel and said extension tab being of fabric construction.

5. In the shirt construction of claim 1, said fastening elements, other than said uppermost fastening element, further characterized as buttons on said first front edge portion, said second front edge portion having a plurality of buttonholes therein for receiving said buttons therein, the uppermost of said buttonholes extending in substantially transverse relation to said second front edge portion.

6. In the shirt construction of claim 2, said reinforcing panel and said extension tab being removably secured to said first front edge portion.

7. An adapter for a shirt comprising an extension tab releasably securable to a collar button of a front buttoning collar-type shirt so that it extends a distance beyond the adjacent edge of said shirt, a fastening tab releasably securable in the respective collar buttonhole of said shirt, and hook and pile type fastening means on said fastening tab and on said extension tab for adjustably securing the front edge portions of said shirt which are adjacent the collar thereof together.

8. The adapter of claim 7 further comprising a reinforcing panel attached to said extension tab and extending therewith beyond the adjacent edge of said shirt, said reinforcing panel extending downwardly from said extension tab and being securable to the next-adjacent button of said shirt when said extension tab is secured to said shirt.

9. In the adapter of claim 8, said reinforcing panel being of a reinforced fabric construction.

10. In the adapter of claim 9, said fastening tab including a button which is receivable in the collar buttonhole of said shirt for securing said fastening tab thereto.

* * * * *